US011764493B2

(12) United States Patent
Takeuchi et al.

(10) Patent No.: US 11,764,493 B2
(45) **Date of Patent: *Sep. 19, 2023**

(54) TERMINAL AND WIRE WITH TERMINAL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Shunya Takeuchi, Mie (JP); Masaaki Tabata, Mie (JP); Hajime Matsui, Mie (JP); Nungna Wi, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 153 days.

This patent is subject to a terminal disclaimer.

(21) Appl. No.: 17/605,378

(22) PCT Filed: Apr. 22, 2020

(86) PCT No.: PCT/JP2020/017319

§ 371 (c)(1),
(2) Date: Oct. 21, 2021

(87) PCT Pub. No.: WO2020/226056

PCT Pub. Date: Nov. 12, 2020

(65) Prior Publication Data

US 2022/0224024 A1 Jul. 14, 2022

(30) Foreign Application Priority Data

May 8, 2019 (JP) ..... 2019-088359

(51) Int. Cl.
*H01R 4/28* (2006.01)

(52) U.S. Cl.
CPC ..... *H01R 4/28* (2013.01)

(58) Field of Classification Search
CPC ... H01R 4/28; H01R 4/48; H01R 4/50; H01R 43/16; H01R 43/514; H01R 43/4364; H01R 43/5213; H01R 43/58; H01R 43/5833

See application file for complete search history.

(56) References Cited

U.S. PATENT DOCUMENTS 4,865,563 A 9/1989 Ney et al.
7,115,004 B2 * 10/2006 Takayama ..... H01R 4/185 439/852

(Continued)

FOREIGN PATENT DOCUMENTS

JP S15-000085 Y1 1/1940
JP H02-158064 A 6/1990

*Primary Examiner* — Harshad C Patel
(74) *Attorney, Agent, or Firm* — Venjuris, P.C.

(57) ABSTRACT

A terminal to be connected to a wire is provided with a terminal body including a sandwiching portion for sandwiching the wire, and a tubular slide portion for accommodating the terminal body inside, the slide portion being slidable with respect to the terminal body. The slide portion includes a wide portion located on a front side in a sliding direction of the slide portion and a narrow portion located behind the wide portion in the sliding direction, an inner shape of the slide portion being narrower in the narrow portion than in the wide portion. The narrow portion is provided with a pressurizing portion projecting inwardly of the slide portion. The pressurizing portion presses the sandwiching portion toward the wire with the slide portion 16 slid in the sliding direction with respect to the terminal body and the narrow portion located outside the sandwiching portion.

9 Claims, 15 Drawing Sheets

(56) References Cited

U.S. PATENT DOCUMENTS

| | | | | |
|---|---|---|---|---|
| 7,306,495 | B2 | 12/2007 | Hashimoto et al. | |
| 10,944,187 | B2 * | 3/2021 | Takeuchi | H01R 4/188 |
| 11,152,718 | B2 * | 10/2021 | Miyamura | H01R 4/5083 |
| 11,165,172 | B2 * | 11/2021 | Miyamura | H01B 7/00 |
| 11,228,152 | B2 * | 1/2022 | Miyamura | H01R 31/06 |
| 11,394,136 | B2 * | 7/2022 | Takeuchi | H01R 13/4361 |
| 11,637,386 | B2 * | 4/2023 | Hara | H01R 4/18 439/775 |
| 2002/0119710 | A1 | 8/2002 | Mello et al. | |
| 2002/0173206 | A1 | 11/2002 | Dobrinski et al. | |
| 2011/0104929 | A1 | 5/2011 | Suzuki et al. | |
| 2018/0331435 | A1 | 11/2018 | Murugiah et al. | |
| 2019/0252803 | A1 * | 8/2019 | Takeuchi | H01R 13/424 |
| 2020/0266556 | A1 * | 8/2020 | Takeuchi | H01R 13/10 |
| 2022/0166159 | A1 * | 5/2022 | Kobayashi | H01R 13/514 |
| 2022/0181796 | A1 * | 6/2022 | Takeuchi | H01R 4/5075 |
| 2022/0231434 | A1 * | 7/2022 | Takeuchi | H01R 4/50 |
| 2022/0239019 | A1 * | 7/2022 | Hara | H01R 4/18 |
| 2022/0263261 | A1 * | 8/2022 | Jo | H01R 4/5075 |
| 2023/0137240 | A1 * | 5/2023 | Takeuchi | H01R 4/5083 439/877 |

* cited by examiner

TERMINAL AND WIRE WITH TERMINAL

CROSS REFERENCE TO RELATED APPLICATIONS

This application is a national phase of PCT application No. PCT/JP2020/017319, filed on 22 Apr. 2020, which claims priority from Japanese patent application No. 2019-088359, filed on 8 May 2019, all of which are incorporated herein by reference.

TECHNICAL FIELD

A technique disclosed in this specification relates to a terminal and a wire with terminal.

BACKGROUND

Conventionally, a wire with terminal is known in which a terminal is connected to a core exposed from an end of a wire. Some of such terminals include, for example, a crimping portion to be crimped to the core exposed from the end of the wire from outside.

The above terminal is crimped to the wire, for example, as follows. First, the terminal of a predetermined shape is formed by press-working a metal plate material. Subsequently, the terminal is placed on a placing portion of a lower die located on a lower side, out of a pair of dies relatively movable in a vertical direction. Subsequently, the core exposed from the end of the wire is placed on the crimping portion of the terminal. Thereafter, one or both of the pair of dies is/are moved in mutually approaching direction(s), and the crimping portion is sandwiched between a crimper of the upper die and the placing portion of the lower die, whereby the crimping portion is crimped to the core of the wire. In the above way, the terminal is connected to the end of the wire (see Patent Document 1).

PRIOR ART DOCUMENT

Patent Document

Patent Document 1: JP 2005-050736 A

SUMMARY OF THE INVENTION

Problems to be Solved

However, according to the above technique, since a relatively large-scale facility such as dies or a jig for crimping the crimping portion of the terminal to the core of the wire is necessary, facility investment is necessary and there is a problem of increasing manufacturing cost.

To solve the above problem, it is considered to use a terminal including a terminal body having a sandwiching portion for sandwiching a wire and a tubular slide portion for accommodating this terminal body. The slide portion is provided with a pressurizing portion for pressing the sandwiching portion toward the wire.

However, according to the above configuration, there is a concern that the sandwiching portion is bent by the contact of the sandwiching portion and the slide portion in a state before the sandwiching portion is pressed by the pressurizing portion.

The technique disclosed in this specification was completed on the basis of the above situation and aims to provide a technique on a terminal with suppressed unintended bending.

Means to Solve the Problem

The present disclosure is directed to a terminal to be connected to a wire, the terminal including a terminal body having a sandwiching portion for sandwiching the wire, and a tubular slide portion for accommodating the terminal body inside, the slide portion being slidable with respect to the terminal body, wherein the slide portion includes a wide portion located on a front side in a sliding direction of the slide portion and a narrow portion located behind the wide portion in the sliding direction, an inner shape of the slide portion being narrower in the narrow portion than in the wide portion, the narrow portion is provided with a pressurizing portion projecting inwardly of the slide portion, the pressurizing portion presses the sandwiching portion toward the wire with the slide portion slid in the sliding direction with respect to the terminal body and the narrow portion located outside the sandwiching portion, and the slide portion is provided with a restricting portion on a side forward of the pressurizing portion in the sliding direction, the restricting portion restricting bending of the sandwiching portion.

Effect of the Invention

According to the present disclosure, it is possible to suppress unintended bending of a terminal.

DETAILED DESCRIPTION TO EXECUTE THE INVENTION

Description of Embodiments of Present Disclosure

Figure 1:
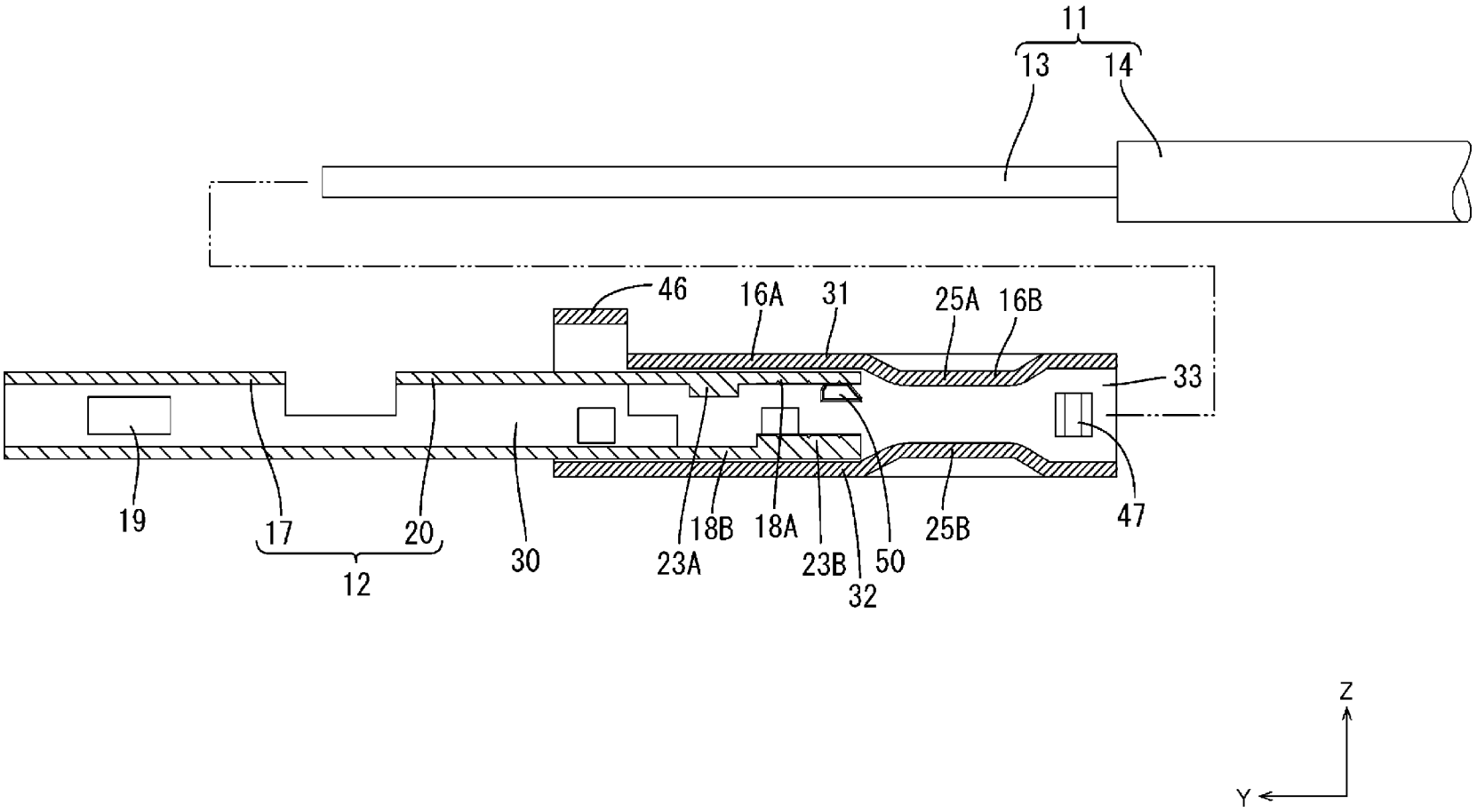
FIG. 1 is an exploded perspective view showing a wire with terminal according to a first embodiment.

First, embodiments of the present disclosure are listed and described.

(1) The terminal of the present disclosure is a terminal to be connected to a wire and includes a terminal body having a sandwiching portion for sandwiching the wire, and a tubular slide portion for accommodating the terminal body inside, the slide portion being slidable with respect to the terminal body, wherein the slide portion includes a wide portion located on a front side in a sliding direction of the slide portion and a narrow portion located behind the wide portion in the sliding direction, an inner shape of the slide portion being narrower in the narrow portion than in the wide portion, the narrow portion is provided with a pressurizing portion projecting inwardly of the slide portion, the pressurizing portion presses the sandwiching portion toward the wire with the slide portion slid in the sliding direction with respect to the terminal body and the narrow portion located outside the sandwiching portion, and the slide portion is provided with a restricting portion on a side forward of the pressurizing portion in the sliding direction, the restricting portion restricting bending of the sandwiching portion.

Since the restricting portion is provided on the side forward of the pressurizing portion in the sliding direction of the slide portion, it can be suppressed that the sandwiching portion is bent by contacting the pressurizing portion in a state before the narrow portion is slid to the outside of the sandwiching portion.

(2) Preferably, the slide portion is so assembled with the terminal body as to be movable between a full locking position where the pressurizing portion is in contact with the sandwiching portion and a partial locking position where the pressurizing portion is separated from the sandwiching portion, and the bending of the sandwiching portion is restricted by the restricting portion with the slide portion disposed at the partial locking position.

Even if the terminal body and the slide portion rattle due to vibration or the like with the slide portion assembled at the partial locking position with the terminal body, unintended bending of the sandwiching portion is suppressed by the restricting portion.

(3) Preferably, the slide portion includes a pressurizing wall provided with the pressurizing portion and a slide-side side wall intersecting the pressurizing wall, the restricting portion projects inwardly of the slide portion from an inner surface of the slide-side side wall, and the sandwiching portion passes between the pressurizing wall and the restricting portion when the slide portion slides.

Unintended bending of the sandwiching portion can be suppressed when the slide portion slides.

(4) Preferably, the slide portion includes a pressurizing wall provided with the pressurizing portion and a slide-side side wall intersecting the pressurizing wall, and a front inclined portion formed to widen an interval between the restricting portion and the pressurizing wall toward a front side in the sliding direction is provided on a front side in the sliding direction of the restricting portion.

The sandwiching portion slides in contact with the front inclined portion, thereby being guided between the restricting portion and the pressurizing wall. In this way, unintended bending of the sandwiching portion is suppressed.

(5) Preferably, a rear inclined portion inclined in a pressurizing direction of the pressurizing portion to pressurize the sandwiching portion toward a rear side in the sliding direction is provided on a rear side in the sliding direction of the restricting portion.

By bending the sandwiching portion along the rear inclined portion, a bending direction of the sandwiching portion can be so controlled that the sandwiching portion is bent in the pressurizing direction toward the rear side in the sliding direction. In this way, the bending of the sandwiching portion in an unintended direction can be suppressed.

(6) Preferably, the sandwiching portion is provided with a projection extending in the sliding direction and projecting in the pressurizing direction of the pressurizing portion to pressurize the sandwiching portion or a direction opposite to the pressurizing direction.

By providing the projection, the strength of a part not desired to be bent, out of the sandwiching portion, can be improved. In this way, unintended bending of the sandwiching portion can be suppressed.

(7) Preferably, the sandwiching portion is provided with an easily bendable portion formed to be narrower than other parts, and the projection is formed to cross the easily bendable portion.

To reliably sandwich the wire, the sandwiching portion is preferably bent at a predetermined position. Accordingly, it is considered to reliably bend the sandwiching portion at the predetermined position by providing the sandwiching portion with the easily bendable portion. On the other hand, by providing the easily bendable portion, the easily bendable portion may be buckled at an unintended timing due to vibration or the like. Accordingly, by forming the projection to cross the easily bendable portion, the strength of the easily bendable portion can be adjusted. In this way, the buckling of the easily bendable portion at an unintended timing can be suppressed.

(8) Preferably, the terminal body includes a body-side side wall intersecting a wall portion provided with the sandwiching portion, the slide portion includes a slide-side side wall intersecting a pressurizing wall provided with the pressurizing portion, one of the body-side side wall and the slide-side side wall includes an engaging projection projecting toward the other and the other of the body-side side wall and the slide-side side wall includes an engaging recess at a position corresponding to the engaging projection, the engaging projection being accommodated into the engaging recess, and one or both of the engaging projection and the engaging recess extend along the sliding direction.

Relative position shifts of the terminal body and the slide portion are suppressed by the contact of the engaging projection accommodated in the engaging recess with the inner wall of the engaging recess. In this way, the rattling of the terminal body and the slide portion by receiving vibration or the like can be suppressed. Further, since the engaging recess extends along the sliding direction, the slide portion can smoothly move along the sliding direction.

(9) A wire with terminal of the present disclosure includes the terminal of any one of (1) to (8) described above, and a wire to be connected to the terminal.

Details of Embodiments of Present Disclosure

Hereinafter, embodiments of the present disclosure are described. The present invention is not limited to these illustrations and is intended to be represented by claims and include all changes in the scope of claims and in the meaning and scope of equivalents.

First Embodiment

A first embodiment of the present disclosure is described with reference to FIGS. 1 to 7. A wire with terminal 10 according to this embodiment includes a wire 11 and a terminal 12 connected to the wire 11. In the following description, a direction indicated by an arrow Z is an upward direction, a direction indicated by an arrow Y is a forward direction and a direction indicated by an arrow X is a leftward direction. Note that, for a plurality of identical members, only some may be denoted by a reference sign and the others may not be denoted by the reference sign.

[Wire 11]

As shown in FIG. 1, the wire 11 is disposed to extend in a front-rear direction (an example of a sliding direction). In the wire 11, the outer periphery of a core 13 is surrounded with an insulation coating 14 made of insulating synthetic resin. The core 13 according to this embodiment is composed of one metal wire. Note that the core 13 may be a stranded wire formed by twisting a plurality of metal thin wires. An arbitrary metal such as copper, copper alloy, aluminum or aluminum alloy can be appropriately selected as a metal constituting the core 13 if necessary. The core 13 according to this embodiment is made of copper or copper alloy.

[Terminal 12]

As shown in FIG. 1, the terminal 12 includes a terminal body 15 made of metal and a slide portion 16 relatively slidable with respect to the terminal body 15.

[Terminal Body 15]

As shown in FIG. 1, the terminal body 15 is formed into a predetermined shape by a known method such as press-working, cutting or casting. An arbitrary metal such as copper, copper alloy, aluminum, aluminum alloy or stainless steel can be appropriately selected as a metal constituting the terminal body 15 if necessary. The terminal body 15 according to this embodiment is made of copper or copper alloy. A plating layer may be formed on the surface of the terminal body 15. An arbitrary metal such as tin, nickel or silver can be appropriately selected as a metal constituting the plating layer if necessary. Tin plating is applied to the terminal body 15 according to this embodiment.

As shown in FIG. 1, the terminal body 15 includes a tube portion 17 into which an unillustrated mating terminal is insertable, and a wire connecting portion 20 located behind the tube portion 17 and to be connected to the wire 11. The wire connecting portion 20 includes an upper sandwiching portion 18A and a lower sandwiching portion 18B extending rearward.

As shown in FIG. 1, the tube portion 17 is in the form of a rectangular tube extending in the front-rear direction. The front end of the tube portion 17 is open, so that the mating terminal is insertable.

A part of a resilient contact piece 19 provided in the tube portion 17 is shown in FIG. 1. Although not shown in detail, the resiliently deformable resilient contact piece 19 is disposed inside the tube portion 17. The resilient contact piece 19 extends inward from the inner wall of the tube portion 17. The mating terminal inserted into the tube portion 17 presses and resiliently deforms the resilient contact piece 19. By a resilient force of the resiliently deformed resilient contact piece 19, the mating terminal is sandwiched between the inner wall of the tube portion 17 and the resilient contact piece 19. In this way, the mating terminal and the terminal 12 are electrically connected.

As shown in FIG. 1, the wire connecting portion 20 in the form of a rectangular tube is provided behind the tube portion 17. The upper sandwiching portion 18A (an example of a sandwiching portion) is provided to extend rearward in a rear end part of the upper wall of the wire connecting portion 20, and the lower sandwiching portion 18B (an example of the sandwiching portion) is provided to extend rearward in a rear end part of the lower wall of the wire connecting portion 20. The upper and lower sandwiching portions 18A, 18B have a shape elongated in the front-rear direction. Lengths in the front-rear direction of the upper and lower sandwiching portions 18A, 18B are substantially equal.

An upper holding protrusion 23A projecting downward is provided in a front end part of the lower surface of the upper sandwiching portion 18A. A lower holding protrusion 23B projecting upward is provided in a rear end part of the upper surface of the lower sandwiching portion 18B. The upper and lower holding protrusions 23A, 23B are formed at positions shifted in the front-rear direction.

The lower surface of the upper sandwiching portion 18A and the upper surface of the lower sandwiching portion 18B bite into an oxide film formed on the surface of the core 13 to peel off the oxide film, whereby a metal surface of the core 13 is exposed. By the contact of this metal surface and the upper and lower sandwiching portions 18A, 18B, the core 13 and the terminal body 15 are electrically connected.

The terminal body 15 is provided with a pair of body-side side walls 30 intersecting both the upper wall provided with the upper sandwiching portion 18A and the lower wall provided with the lower sandwiching portion 18B. Both side edges of the upper and lower walls of the terminal body 15 are coupled by the pair of body-side side walls 30.

[Slide Portion 16]

Figure 2:
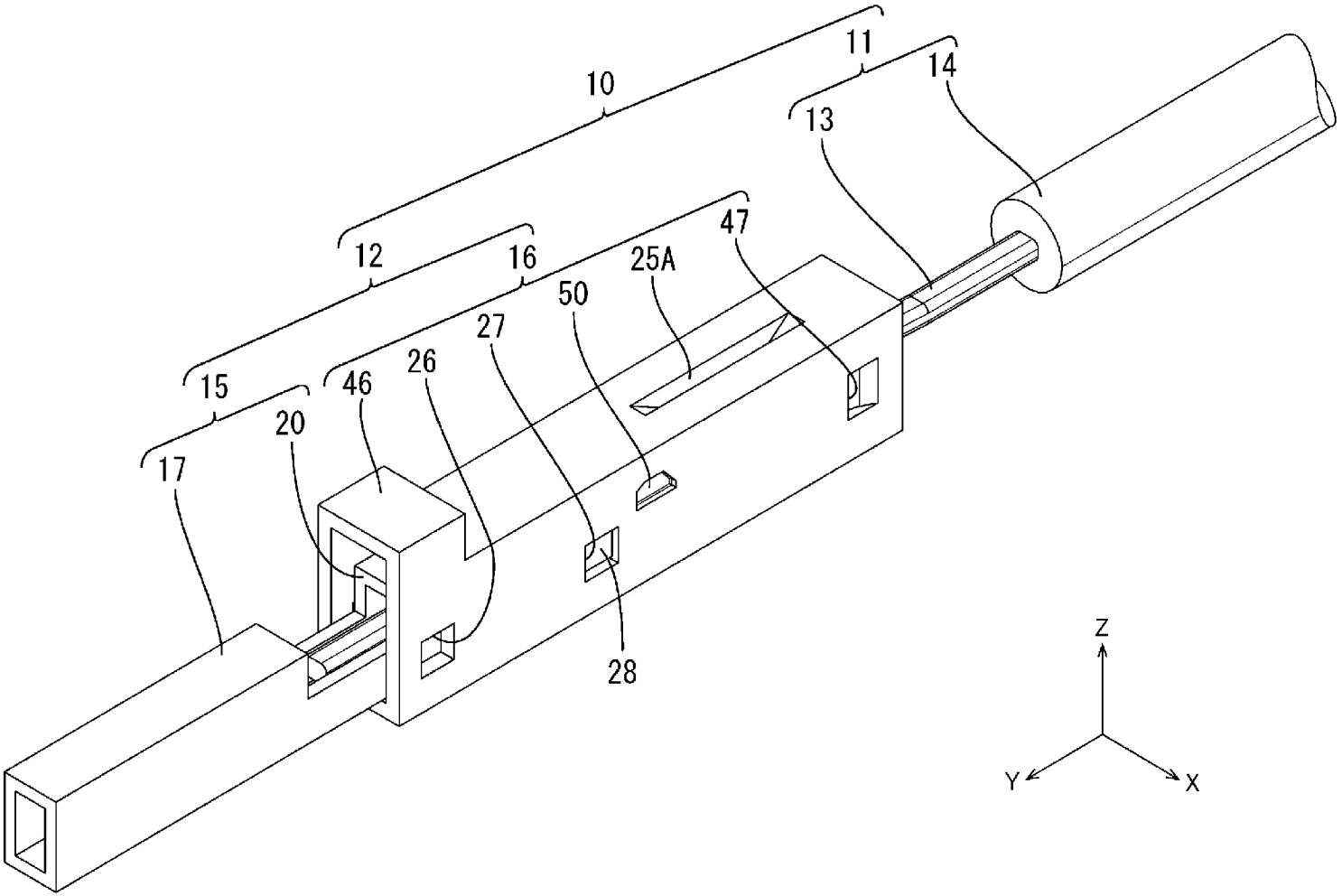
FIG. 2 is a perspective view showing the wire with terminal.

As shown in FIG. 2, the slide portion 16 is in the form of a rectangular tube extending in the front-rear direction. The slide portion 16 is formed by a known method such as cutting, casting or press-working if necessary. An arbitrary metal such as copper, copper alloy, aluminum, aluminum alloy or stainless steel can be appropriately selected as a metal constituting the slide portion 16 if necessary. The slide portion 16 according to this embodiment is made of stainless steel. A plating layer may be formed on the surface of the slide portion 16. An arbitrary metal such as tin, nickel or silver can be appropriately selected as a metal constituting the plating layer if necessary.

A cross-section of the inner shape of a front half of the slide portion 16 is the same as or somewhat larger than that of the outer shape of a region of the terminal body 15 where the upper and lower sandwiching portions 18A, 18B are provided. In this way, the front half of the slide portion 16 is disposed outside the region of the terminal body 15 where the upper and lower sandwiching portions 18A, 18B are provided. In the following description, the front half of the slide portion 16A may be written as a wide portion 16A.

As shown in FIG. 1, an upper pressurizing portion 25A (an example of a pressurizing portion) projecting downward is provided on an upper pressurizing wall 31 (an example of a pressurizing wall) constituting the upper wall of the slide portion 16. A lower pressurizing portion 25B (an example of the pressurizing portion) projecting upward is provided on a lower pressurizing wall 32 (an example of the pressurizing wall) constituting the lower wall of the slide portion 16. A part of the slide portion 16 where the upper and lower pressurizing portions 25A, 25B are provided serves as a narrow portion 16B in which a cross-section of the inner shape of the slide portion 16 is narrower than in the wide portion 16A.

The slide portion 16 is formed with a pair of slide-side side walls 33 intersecting the upper and lower pressurizing walls 31, 32. Both side edges of the upper and lower pressurizing walls 31, 32 are coupled by the pair of slide-side side walls 33.

As shown in FIG. 1, a partial lock receiving portion 26 is open at a position near a front end part in the slide-side side wall 33 of the slide portion 16. Further, a full lock receiving portion 27 is open at a position behind the partial lock receiving portion 26 in the slide-side side wall 33 of the slide portion 16. The partial lock receiving portion 26 and the full lock receiving portion 27 are resiliently lockable to a locking projection 28 provided on the side wall of the terminal body 15.

As shown in FIG. 1, with the locking projection 28 of the terminal body 15 and the partial lock receiving portion 26 of the slide portion 16 locked, the slide portion 16 is held at a partial locking position with respect to the terminal body 15. In this state, the wide portion 16A is located outside the upper and lower sandwiching portions 18A, 18B of the terminal body 15. In a partially locked state, the upper and lower pressurizing portions 25A, 25B of the slide portion 16 are separated rearward from the rear end edges of the upper and lower sandwiching portions 18A, 18B of the terminal body 15.

Figure 9:
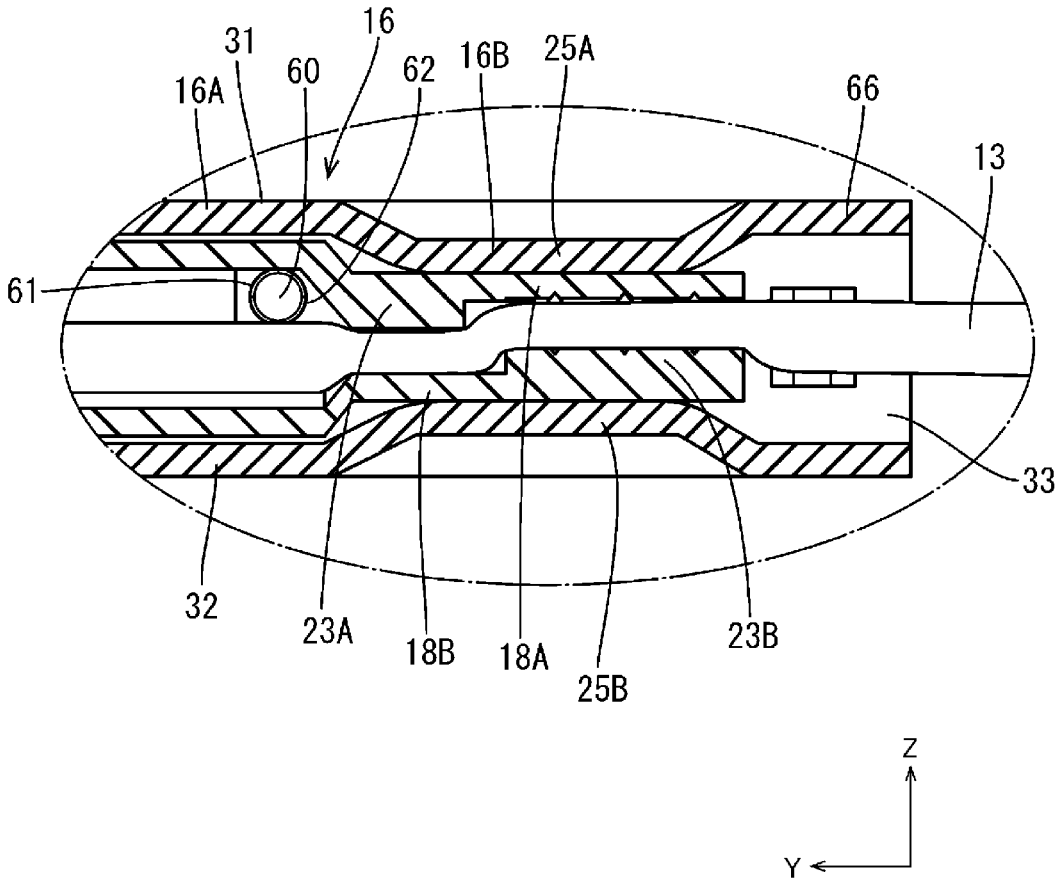
FIG. 9 is a partial enlarged section showing a restricting portion according to the second embodiment.

With the locking projection 28 of the terminal body 15 and the full lock receiving portion 27 of the slide portion 16 locked, the slide portion 16 is held at a full locking position with respect to the terminal body 15. As shown in FIG. 9, in this state, the narrow portion 16B is located outside the upper and lower sandwiching portions 18A, 18B of the terminal body 15. In a fully locked state, the upper pressurizing portion 25A of the slide portion 16 is in contact with the upper sandwiching portion 18A from above the upper sandwiching portion 18A. Further, the lower pressurizing portion 25B of the slide portion 16 is in contact with the lower sandwiching portion 18B from below the lower sandwiching portion 18B.

As described above, the slide portion 16 is slidable in the front-rear direction between the partial locking position and the full locking position described above while being externally fit to the region of the terminal body 15 where the upper and lower sandwiching portions 18A, 18B are provided.

Figure 3:
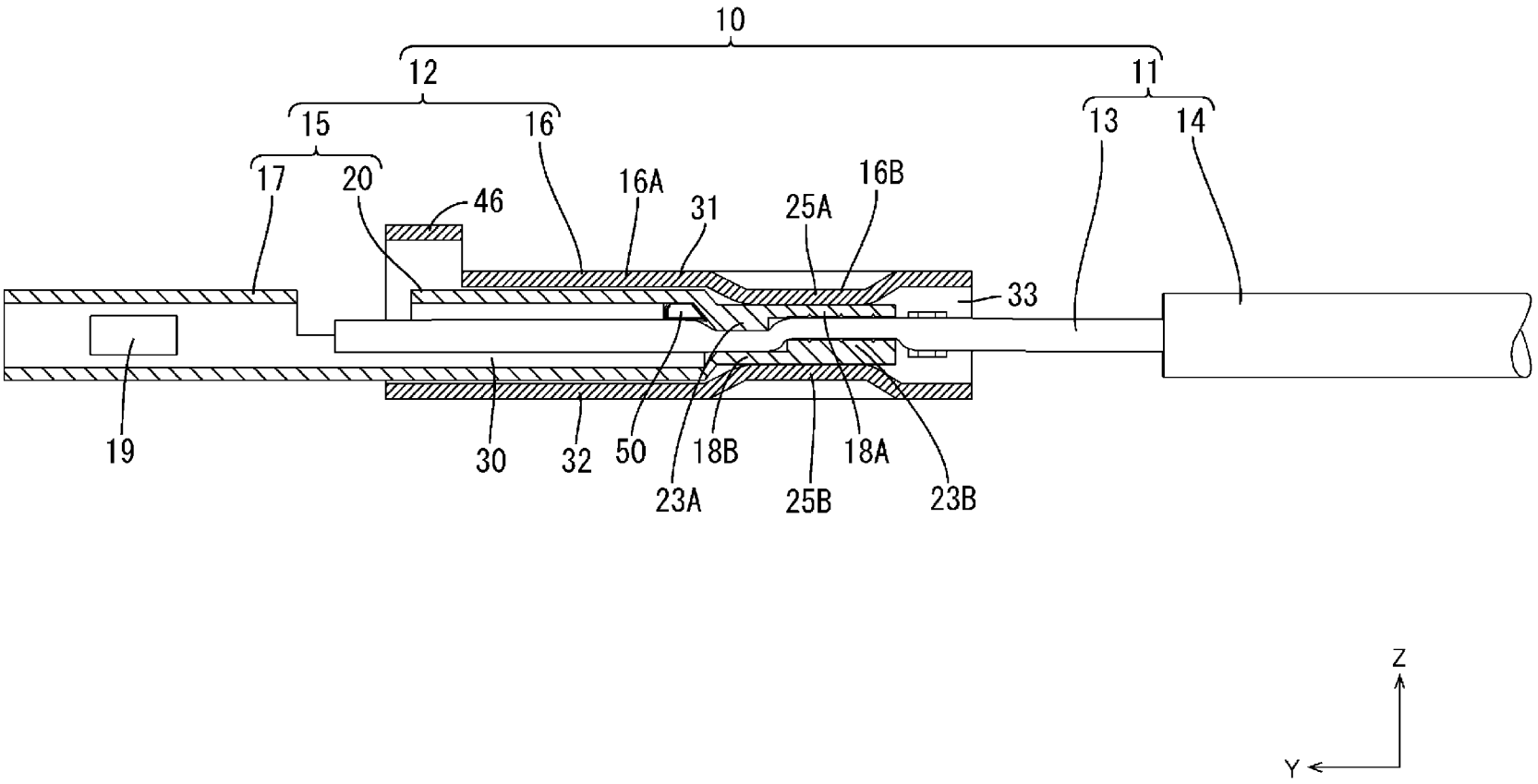
FIG. 3 is a section showing the wire with terminal.

As shown in FIG. 3, with the slide portion 16 held at the full locking position with respect to the terminal body 15, the upper pressurizing portion 25A presses the upper sandwiching portion 18A from above, thereby deforming the upper sandwiching portion 18A downward. Further, the lower pressurizing portion 25B presses the lower sandwiching portion 18B from below, thereby deforming the lower sandwiching portion 18B upward. In this way, with the core 13 extending in the front-rear direction in a space between the upper and lower sandwiching portions 18A, 18B and the slide portion 16 held at the full locking position with respect to the terminal body 15, the core 13 is vertically sandwiched by the resiliently deformed upper and lower sandwiching portions 18A, 18B. That is, the upper sandwiching portion 18A contacts the core 13 from above by being pressed downward by the upper pressurizing portion 25A, and the lower sandwiching portion 18B contacts the core 13 from below by being pressed upward by the lower pressurizing portion 25B. Since the upper pressurizing portion 25A presses the upper sandwiching portion 18A downward from above, a direction from up to down is a pressing direction. Since the lower pressurizing portion 25B presses the lower sandwiching portion 18AB upward from below, a direction from down to up is a pressing direction.

As shown in FIG. 3, with the slide portion 16 held at the full locking position with respect to the terminal body 15, the upper holding protrusion 23A of the upper sandwiching portion 18A presses the core 13 from above and the lower holding protrusion 23B of the lower sandwiching portion 18B presses the core 13 from below. In this way, the core 13 is pressed by the upper and lower holding protrusion 23A, 23B, thereby being held in a state bent in the vertical direction. The core 13 and the terminal 12 are electrically connected also by the upper and lower holding protrusions 23A, 23B.

Figure 5:
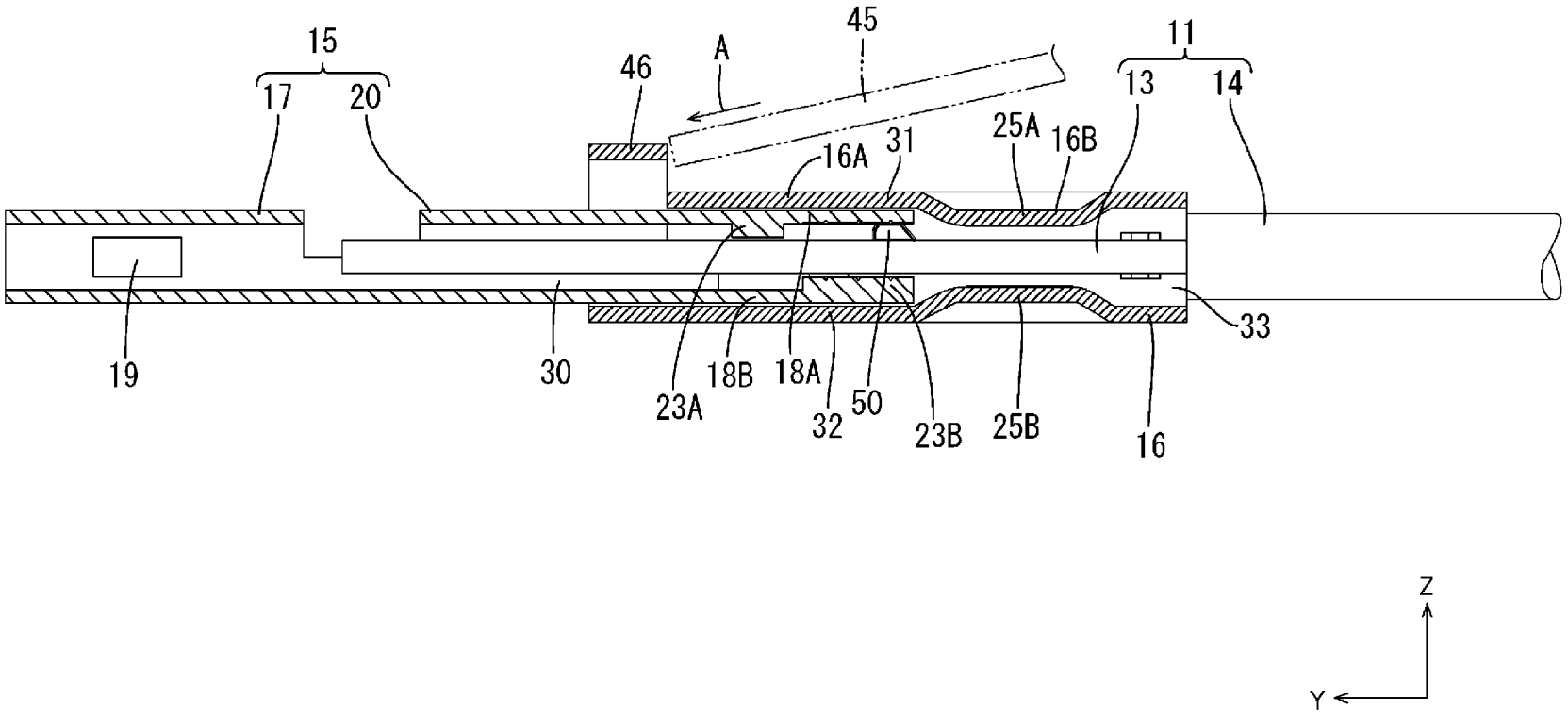
FIG. 5 is a section showing a step of moving a slide portion held at a partial locking position with respect to a terminal body forward.

As shown in FIG. 5, a jig contact portion 46 projecting upward from the upper pressurizing wall 31 is provided in a front end part of the slide portion 16. By bringing a jig 45 into contact with the jig contact portion 46 from behind and pushing the slide portion 16 forward (direction indicated by an arrow A) by this jig 45, the slide portion 16 is movable forward. Note that the jig 45 is relatively smaller in scale as compared to dies and a facility for operating these dies. Thus, a cost increase due to the jig 45 is suppressed.

As shown in FIGS. 1 and 2, a pair of guiding portions 47 projecting inwardly of the slide portion 16 are provided at positions near a rear end part of the slide portion 16 on both left and right slide-side side walls 33. The guiding portions 47 are formed to become narrower from a rear side toward a front side. The core 13 slides in contact with the inner surfaces of the guiding portions 47, thereby being guided into the slide portion 16.

[Restricting Portion 50]

As shown in FIG. 1, the left and right slide-side side walls 33 are formed with restricting portions 50 projecting inwardly of the slide portion 16. The restricting portions 50 are formed at positions near the top of the slide portion 16 and somewhat forward of the upper pressurizing portion 25A.

Figure 4:
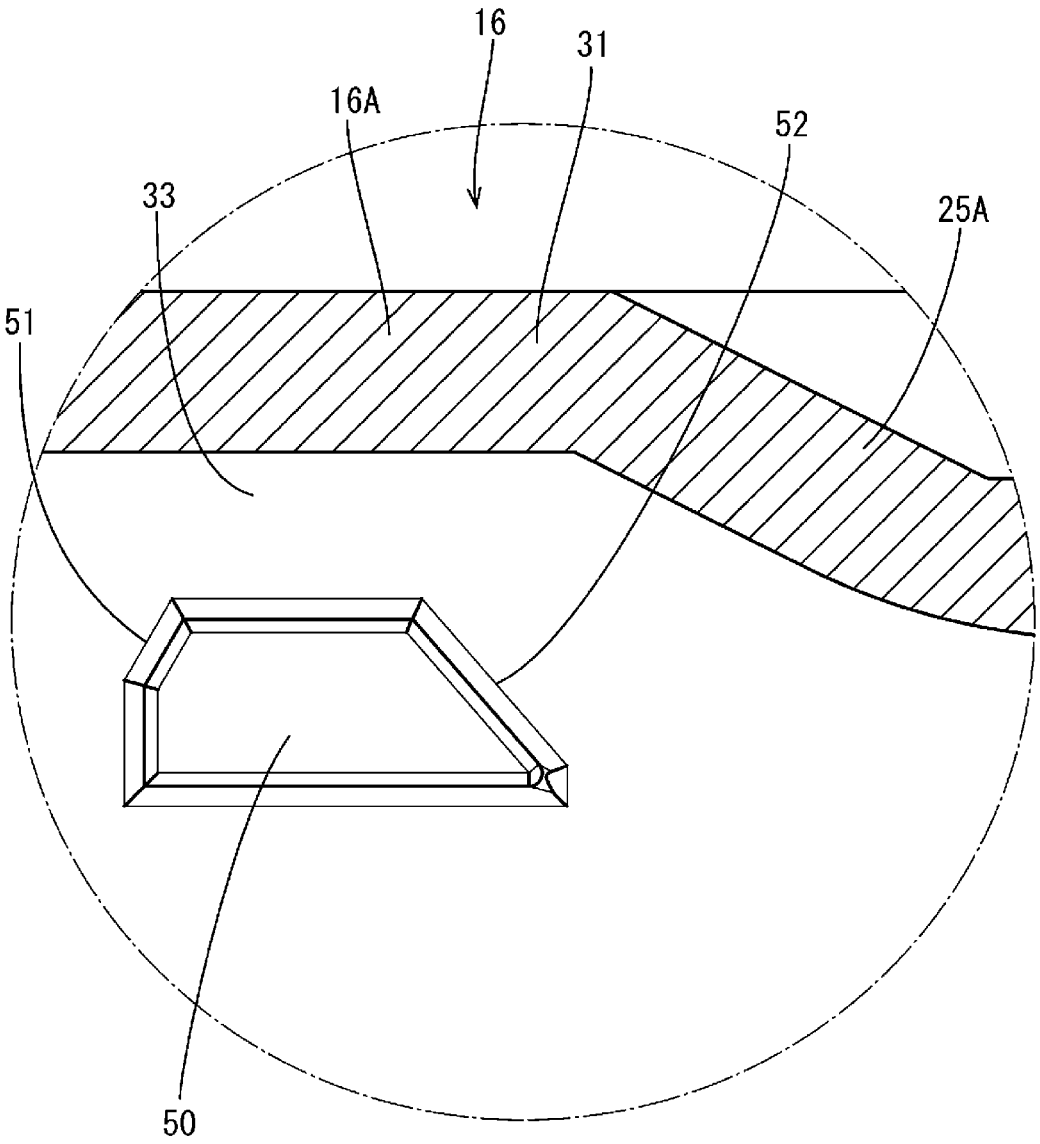
FIG. 4 is a partial enlarged view showing a restricting portion.

The restricting portion 50 is formed by press-working the slide-side side wall 33. As shown in FIG. 4, the restricting portion 50 has a substantially trapezoidal shape when viewed laterally. The upper and lower surfaces of the restricting portion 50 are formed to be parallel in the front-rear direction. Parallel means not only a case where things are parallel, but also a case where things are not parallel, but can be recognized to be substantially parallel. An interval between the upper surface of the restricting portion 50 and the upper pressurizing wall 31 is set to be larger than a vertical thickness of the tip of the upper sandwiching portion 18A.

The front surface of the restricting portion 50 is formed to extend in the vertical direction. A corner on an upper end part of the front surface of the restricting portion 50 is chamfered. In this way, a front inclined portion 51 formed to widen the interval between the restricting portion 50 and the upper pressurizing wall 31 toward the front side is formed on a front side of the restricting portion 50. The tip of the upper sandwiching portion 18A slides in contact with the front inclined portion 51, whereby the tip of the upper sandwiching portion 18A is guided between the upper surface of the restricting portion 50 and the upper pressurizing wall 31.

A rear inclined portion 52 inclined downward toward the rear side is formed in a rear part of the restricting portion 50. The front surface of the upper pressurizing portion 25A is formed to be obliquely inclined downward to a lower-rear side. An interval between the rear inclined portion 52 of the restricting portion 50 and the front surface of the upper pressurizing portion 25A is formed to be widened toward the rear side.

[Connection Process of Wire 11]

Next, an example of a connection process of the wire 11 and the terminal 12 is described. The connection process of the wire 11 and the terminal 12 is not limited to the one described below.

The terminal body 15 and the slide portion 16 are formed by a known method. The slide portion 16 is assembled with the terminal body 15 from behind. The front end edge of the slide portion 16 comes into contact with the locking projection 28 of the terminal body 15 from behind and the slide-side side wall 33 of the slide portion 16 is expanded and deformed. If the slide portion 16 is further pushed forward, the slide-side side wall 33 is restored and the partial lock receiving portion 26 of the slide portion 16 is locked to the locking projection 28 of the terminal body 15. In this way, the slide portion 16 is held at the partial locking position with respect to the terminal body 15. The wide portion 16A is located outside the upper and lower sandwiching portions 18A, 18B. Further, the tip of the upper sandwiching portion 18A slides in contact with the front inclined portions 51 of the restricting portions 50, thereby being inserted between the upper surfaces of the restricting portions 50 and the upper pressurizing wall 31.

The core 13 of the wire 11 is exposed by stripping the insulation coating 14 by a known method.

Figure 6:
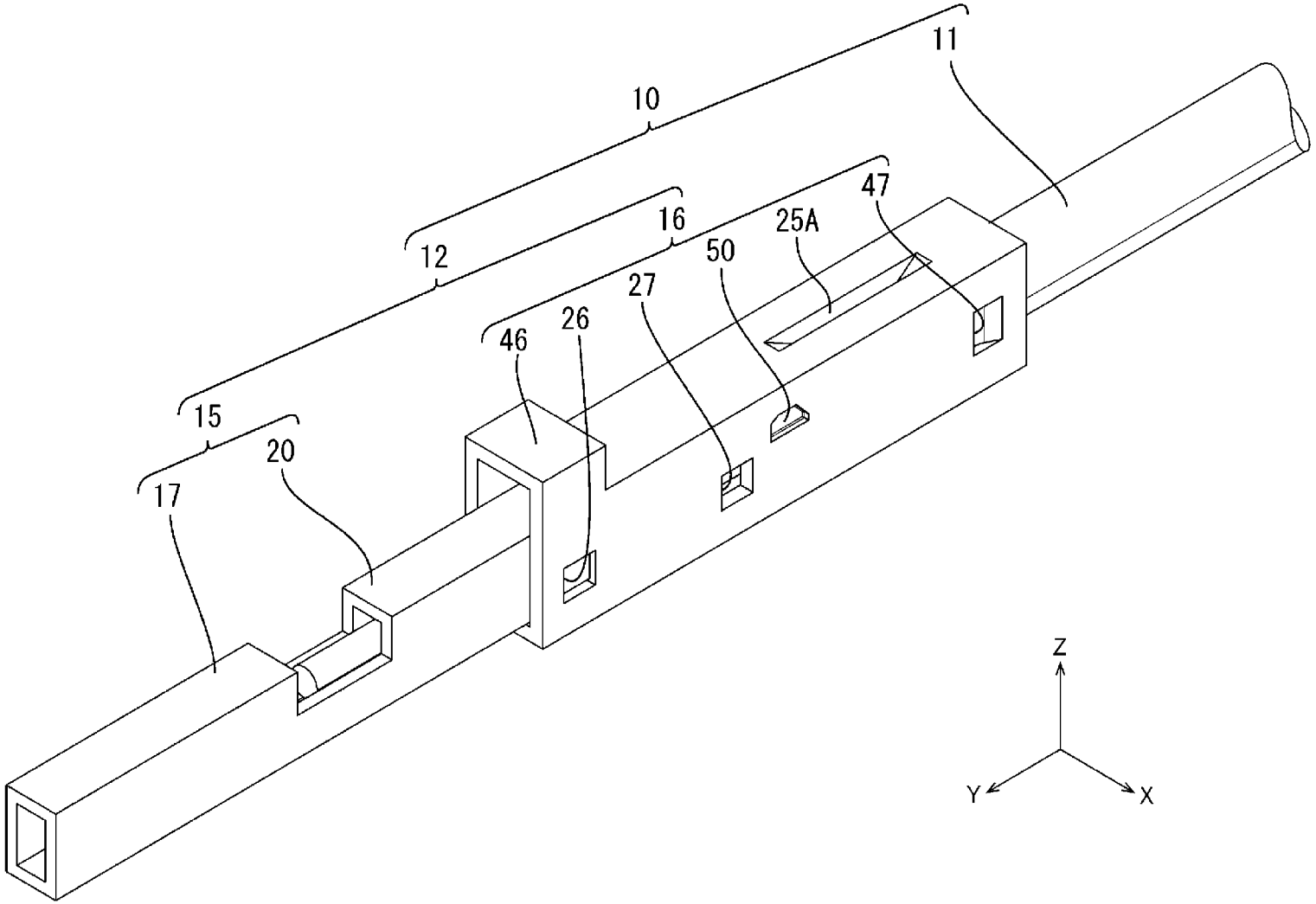
FIG. 6 is a perspective view showing a state where the slide portion is held at the partial locking position with respect to the terminal body.

As shown in FIGS. 5 and 6, the core 13 is inserted from behind into the terminal 12 in which the terminal body 15 and the slide portion 16 are partially locked. The core 13 comes into contact with the guiding portions 47 of the slide portion 16, thereby being guided into the slide portion 16. If the wire 11 is further pushed forward, a front end part of the core 13 enters the terminal body 15 and reaches the space between the upper and lower sandwiching portions 18A, 18B.

Subsequently, as shown in FIG. 5, the slide portion 16 is slid forward by bringing the jig 45 into contact with the jig contact portion 46 from behind. The slide portion 16 is relatively moved forward with respect to the terminal body 15. At this time, locking between the locking projection 28 of the terminal body 15 and the partial lock receiving portion 26 of the slide portion 16 is released and the side wall of the slide portion 16 rides on the locking projection 28 to be expanded and deformed.

Figure 7:
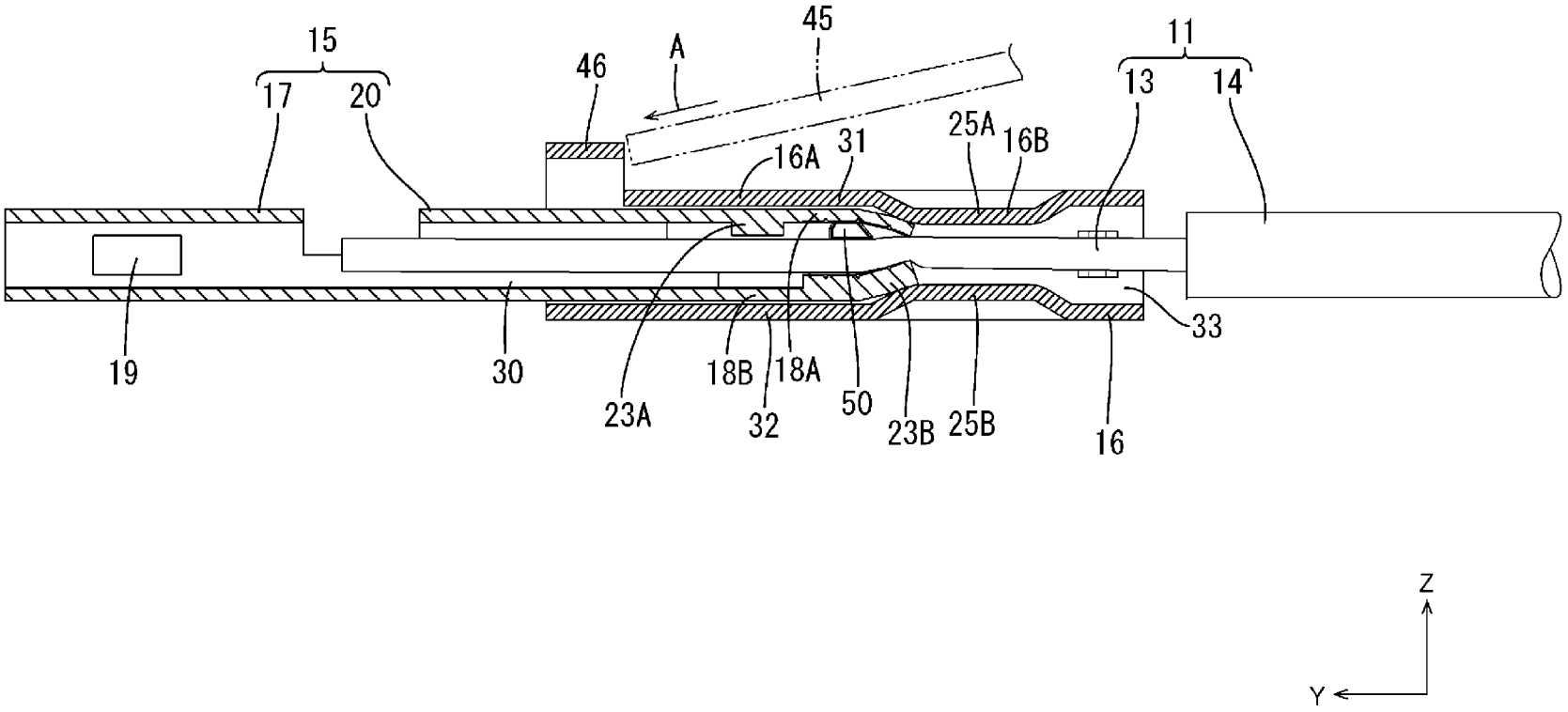
FIG. 7 is a perspective view showing a step of moving the slide portion forward.

As shown in FIG. 7, the tip of the upper sandwiching portion 18A enters between the upper pressurizing portion 25A and the rear inclined portions 52 to be bent downward. At this time, since the restricting portions 50 are disposed below the upper sandwiching portion 18A, downward excessive deflection of the upper sandwiching portion 18A is suppressed.

If the slide portion 16 is moved forward, the slide-side side wall 33 is restored and the locking projection 28 of the terminal body 15 and the full lock receiving portion 27 of the slide portion 16 are resiliently locked. In this way, the slide portion 16 is held at the full locking position with respect to the terminal body 15. In this state, the narrow portion 16B is located outside the upper and lower sandwiching portions 18A, 18B.

As shown in FIG. 3, with the slide portion 16 held at the full locking position with respect to the terminal body 15, the upper pressurizing portion 25A of the slide portion 16 comes into contact with the upper sandwiching portion 18A of the terminal body 15 from above to press the upper sandwiching portion 18A downward. Further, the lower pressurizing portion 25B of the slide portion 16 comes into contact with the lower sandwiching portion 18B of the terminal body 15 from below to press the lower sandwiching portion 18B upward.

As shown in FIG. 3, the core 13 is sandwiched by the lower surface of the upper sandwiching portion 18A and the upper surface of the lower sandwiching portion 18B, whereby the oxide film formed on the surface of the core 13 is peeled off to expose the metal surface constituting the core 13. By the contact of this metal surface with the upper and lower sandwiching portions 18A, 18B, the wire 11 and the terminal 12 are electrically connected.

With the core 13 sandwiched from upper and lower sides by the upper and lower sandwiching portions 18A, 18B, the core 13 is sandwiched by the upper holding protrusion 23A of the upper sandwiching portion 18A and the lower holding protrusion 23B of the lower sandwiching portion 18B, thereby being held in the state extending in the front-rear direction and bent in the vertical direction. Since the core 13 can be firmly held in this way, a holding force of the wire 11 and the terminal 12 can be enhanced when a pulling force is applied to the wire 11.

Functions and Effects of Embodiment

Next, functions and effects of this embodiment are described. This embodiment relates to the terminal 12 to be connected to the wire 11 and including the terminal body 15 having the upper and lower sandwiching portions 18A, 18B for sandwiching the wire 11, and the tubular slide portion 16 for accommodating the terminal body 15 inside, wherein the slide portion 16 includes the wide portion 16A located on the front side in the sliding direction of the slide portion 16 and the narrow portion 16B located behind the wide portion 16A in the sliding direction, the inner shape of the slide portion 16 being narrower in the narrow portion 16B than in the wide portion 16A, the narrow portion 16B is provided with the upper and lower pressurizing portions 25A, 25B projecting inwardly of the slide portion 16, the upper pressurizing portion 25A presses the upper sandwiching portion 18A toward the core 13 of the wire 11 with the slide portion 16 slid in the sliding direction with respect to the terminal body 15 and the narrow portion 16B located outside the upper and lower sandwiching portions 18A, 18B, and the slide portion 16 is provided with the restricting portions 50 for restricting the bending of the upper sandwiching portion 18A on a side forward of the upper pressurizing portion 25A in the sliding direction.

Further, this embodiment relates to the wire with terminal 10 including the wire 11 and the terminal 12 connected to the wire 11.

Since the restricting portions 50 are provided on the side forward of the upper pressurizing portion 25A in the sliding direction of the slide portion 16, it can be suppressed that the upper sandwiching portion 18A is bent by contacting the upper pressurizing portion 25A in a state before the narrow portion 16B slides to the outside of the upper sandwiching portion 18A.

According to this embodiment, the slide portion 16 is so assembled with the terminal body 15 as to be movable between the full locking position where the upper and lower pressurizing portions 25A, 25B are in contact with the upper and lower sandwiching portions 18A, 18B and the partial locking position where the upper and lower pressurizing portions 25A, 25B are separated from the upper and lower sandwiching portions 18A, 18B, and the bending of the upper sandwiching portion 18A is restricted by the restricting portions 50 with the slide portion 16 disposed at the partial locking position.

With the slide portion 16 assembled at the partial locking position with the terminal body 15, even if the terminal body 15 and the slide portion 16 rattle due to vibration or the like, unintended bending of the upper sandwiching portion 18A is suppressed by the restricting portions 50.

According to this embodiment, the slide portion 16 includes the upper pressurizing wall 31 provided with the upper pressurizing portion 25A and the slide-side side walls 33 intersecting the upper pressurizing wall 31, the restricting portions 50 project inwardly of the slide portion 16 from the inner surfaces of the slide-side side walls 33, and the upper sandwiching portion 18A passes between the upper pressurizing wall 31 and the restricting portions 50 when the slide portion 16 slides.

In this way, unintended bending of the upper sandwiching portion 18A can be suppressed when the slide portion 16 slides.

According to this embodiment, the slide portion 16 includes the upper pressurizing wall 31 provided with the upper pressurizing portion 25A and the slide-side side walls 33 intersecting the upper pressurizing wall 31, and the front inclined portions 51 formed to widen the intervals between the restricting portions 50 and the upper pressurizing wall 31 toward the front side in the sliding direction are provided on the front sides in the sliding direction of the restricting portions 50.

The upper sandwiching portion 18A slides in contact with the front inclined portions 51, whereby the upper sandwiching portion 18A is guided between the restricting portions 50 and the upper pressurizing wall 31. In this way, unintended bending of the upper sandwiching portion 18A can be suppressed.

According to this embodiment, the rear inclined portions 52 inclined in a pressurizing direction of the upper pressurizing portion 25A to press the upper sandwiching portion 18A toward the rear side in the sliding direction are provided on the rear sides in the sliding direction of the restricting portions 50.

The upper sandwiching portion 18A is bent along the rear inclined portions 52, whereby a bending direction of the upper sandwiching portion 18A can be so controlled that the upper sandwiching portion 18A is bent in the pressurizing direction toward the rear side in the sliding direction. In this way, the bending of the upper sandwiching portion 18A in an unintended direction can be suppressed.

Second Embodiment

Figure 8:
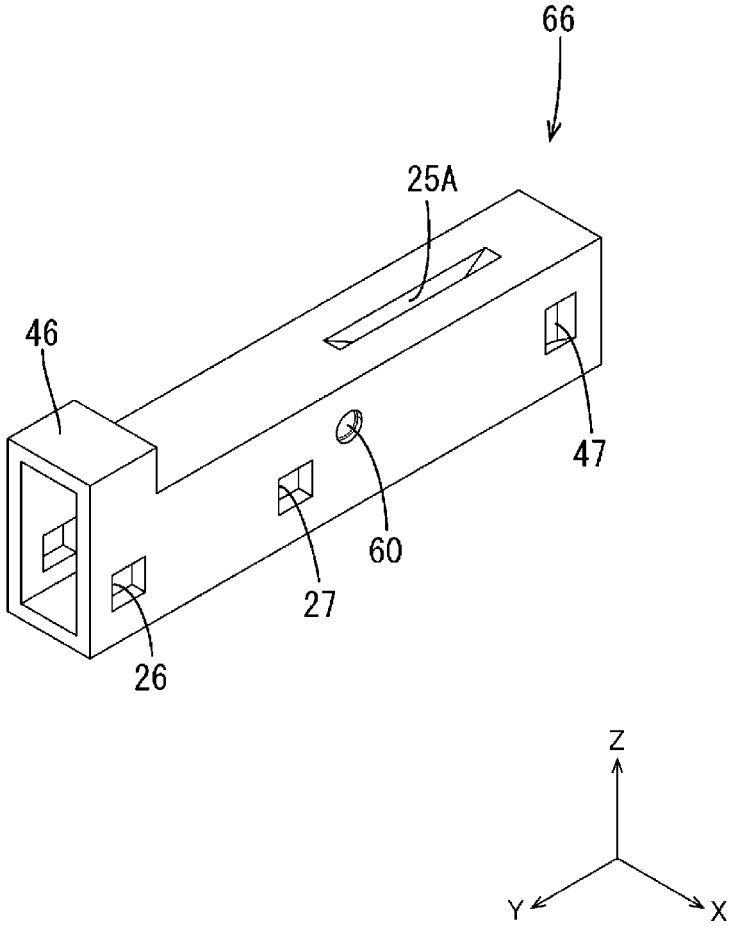
FIG. 8 is a perspective view showing a slide portion according to a second embodiment.

Next, a second embodiment of the present disclosure is described with reference to FIGS. 8 and 9. As shown in FIGS. 8 and 9, restricting portions 60 according to this embodiment have a cylindrical shape and project from left and right slide-side side walls 33 of a slide portion 66.

A semi-circular surface formed on the front surface of the restricting portion 60 serves as a front inclined portion 61 for guiding an upper sandwiching portion 18A between the restricting portion 60 and an upper pressurizing wall 31 by sliding in contact with the upper sandwiching portion 18A.

A semi-circular surface formed on the rear surface of the restricting portion 60 serves as a rear inclined portion 62 inclined downward toward a rear side.

Since the configuration other than the above is substantially the same as in the first embodiment, the same members are denoted by the same reference signs and repeated description is omitted.

Since the restricting portion 60 according to this embodiment has a cylindrical shape, the restricting portion 60 is easily formed by press-working.

Further, since the front inclined portions 61 formed on the front surfaces of the restricting portions 60 are semi-circular surfaces, the upper sandwiching portion 18A is easily guided between the restricting portions 60 and the upper pressurizing wall 31. In this way, unintended bending of the upper sandwiching portion 18A can be suppressed.

Further, since the rear inclined portions 62 formed on the rear surfaces of the restricting portions 60 are semi-circular surfaces, the upper sandwiching portion 18A is easily guided between the restricting portions 60 and an upper pressurizing portion 25A. In this way, unintended bending of the upper sandwiching portion 18A can be suppressed.

Third Embodiment

Figure 10:
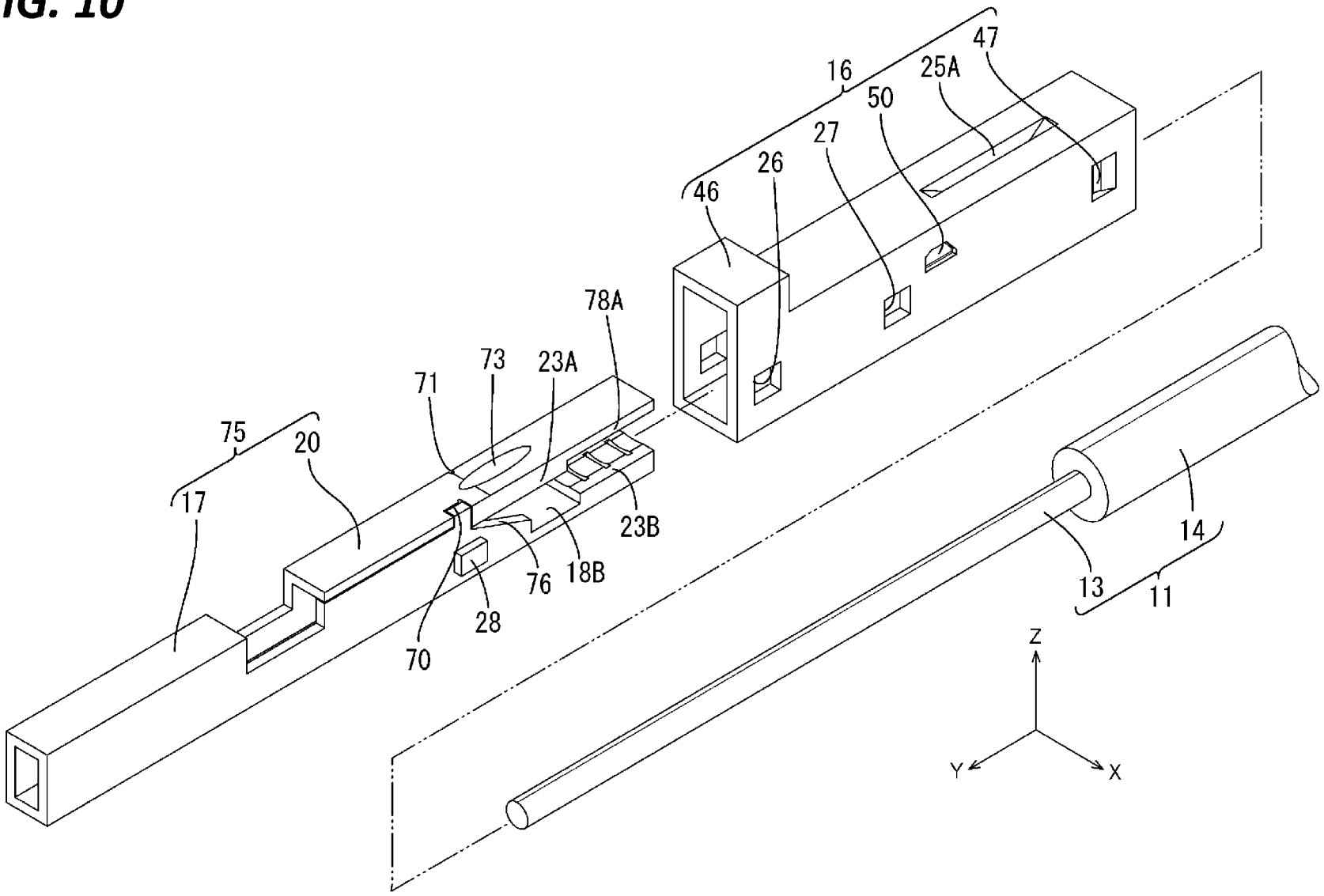
FIG. 10 is a perspective view showing a terminal body, a slide portion and a wire according to a third embodiment.

Next, a third embodiment of the present disclosure is described with reference to FIGS. 10 to 12. A terminal body 75 according to this embodiment is formed by press-working one metal plate material. As shown in FIG. 10, a first easily bendable portion 70 cut rightward from the left side edge of an upper sandwiching portion 78A is formed in a front end part of the upper sandwiching portion 78A according to this embodiment. A second easily bendable portion 71 cut leftward is formed at a position behind the first easily bendable portion 70 on the right side edge of the upper sandwiching portion 78A. The first and second easily bendable portions 70, 71 are formed to be narrower than other parts of the upper sandwiching portion 78A. In this way, the first and second easily bendable portions 70, 71 are easily bent as compared to the other parts of the upper sandwiching portion 78A when being pressed downward by an upper pressurizing portion 25A.

Figure 11:
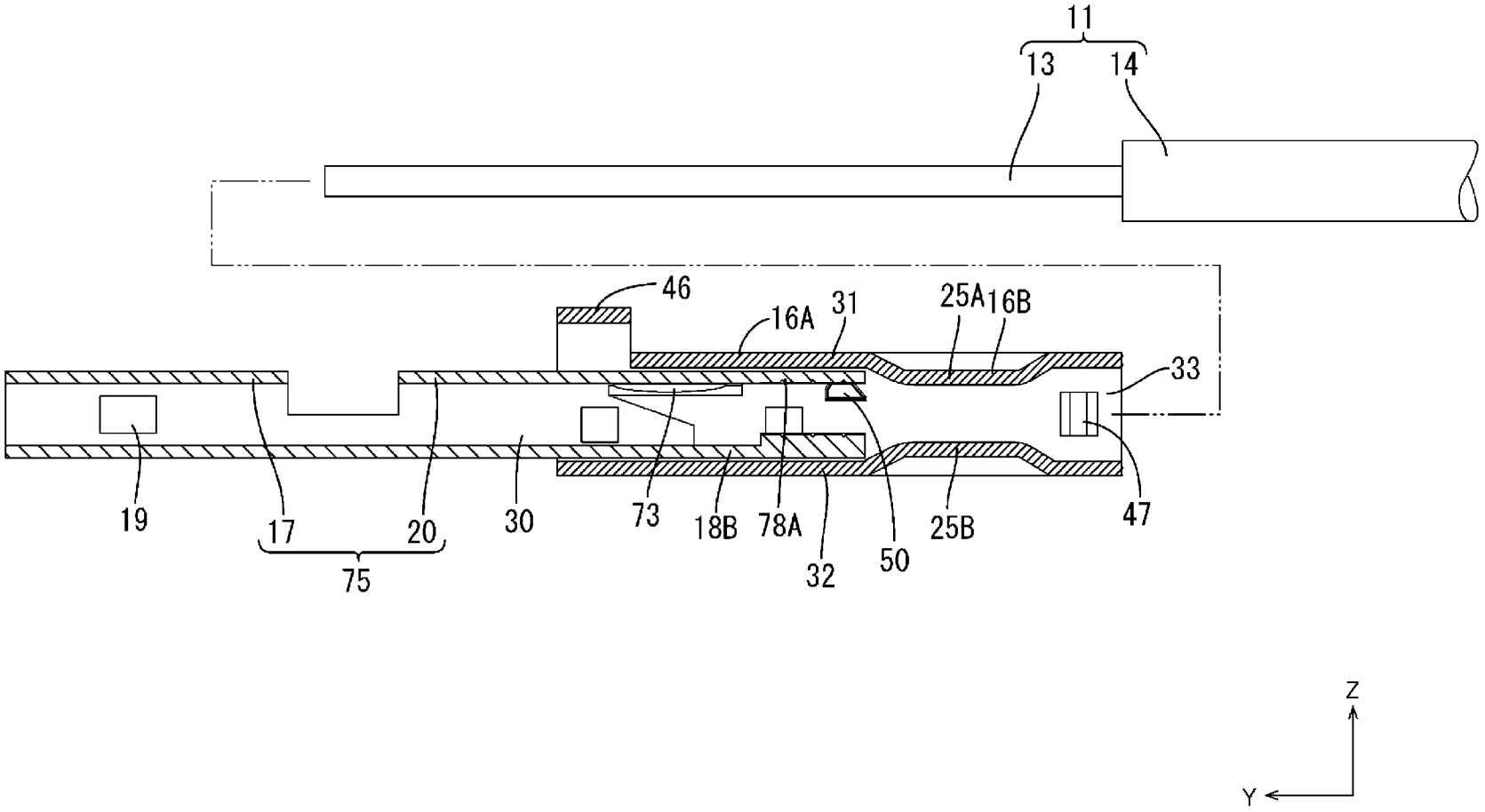
FIG. 11 is a section showing the terminal body, the slide portion and the wire according to the third embodiment.

As shown in FIG. 11, a projection 73 is formed to project downward on the upper sandwiching portion 78A. The projection 73 extends along the front-rear direction. The shape of the projection 73 is not limited and may be, for example, an oval shape when viewed from above.

Figure 12:
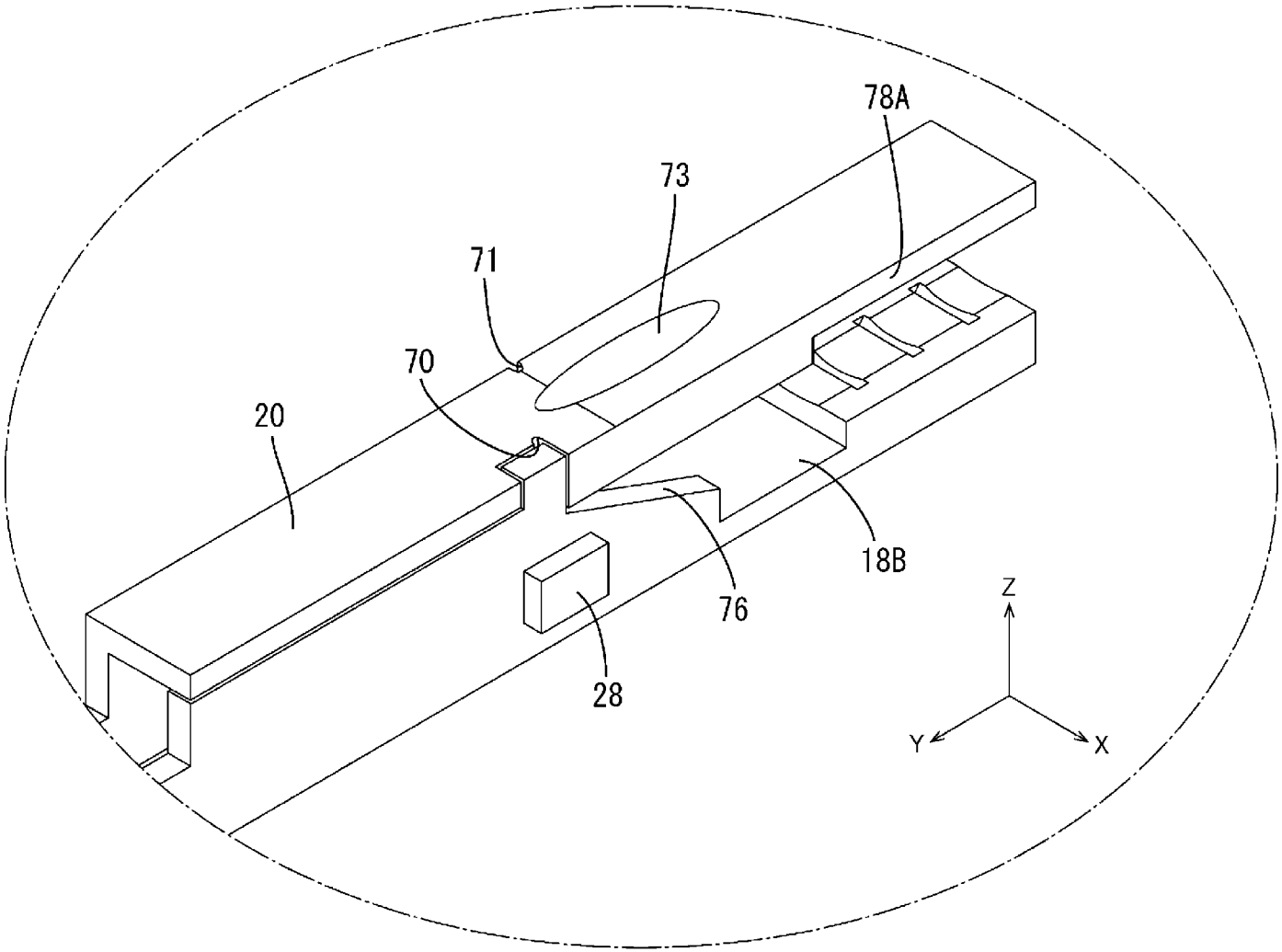
FIG. 12 is a partial enlarged perspective view showing a projection.

As shown in FIG. 12, a front end part of the projection 73 is formed at a position behind the first easily bendable portion 70 and in front of the second easily bendable portion 71. A rear end part of the projection 73 is formed at a position behind the second easily bendable portion 71. In this way, the projection 73 is formed to cross the second easily bendable portion 71 in the front-rear direction.

An excessive deflection suppressing portion 76 for suppressing excessive deflection when the upper sandwiching portion 78A is deformed downward is provided below the left side edge of the upper sandwiching portion 78A, out of the terminal body 75. The excessive deflection suppressing portion 76 is formed as a slope inclined downward toward a rear side on the upper surface of the left side wall of the terminal body 75.

Since the configuration other than the above is substantially the same as in the first embodiment, the same members are denoted by the same reference signs and repeated description is omitted.

According to this embodiment, the upper sandwiching portion 78A extends along the front-rear direction and is provided with the projection 73 projecting downward.

Since the strength of the upper sandwiching portion 78A is improved by providing the projection 73, unintended deformation of the upper sandwiching portion 78A is suppressed.

The upper sandwiching portion 78A is provided with the second easily bendable portion 71 formed to be narrower than the other parts and the projection 73 is formed to cross the second easily bendable portion 71.

To reliably sandwich the wire 11 by the upper sandwiching portion 78A, the upper sandwiching portion 78A is preferably bent at a predetermined position. Accordingly, it is considered to reliably bend the upper sandwiching portion 78A at the predetermined position by providing the second easily bendable portion 71 at a position behind the first easily bendable portion 70. By forming easily bendable parts of the upper sandwiching portion 78A separated in the front-rear direction, the upper sandwiching portion 78A can be gently bent.

On the other hand, by providing the first and second easily bendable portions 70, 71, the first or second easily bendable portion 70, 71 may be buckled at an unintended timing due to vibration or the like. Particularly, the second easily bendable portion 71 formed behind the first easily bendable portion 70 is easily buckled since being closer to the tip of the upper sandwiching portion 78A. Accordingly, by forming the projection 73 to cross the second easily bendable portion 71, the strength of the second easily bendable portion 71 can be adjusted. In this way, the buckling of the second easily bendable portion 71 at an unintended timing can be suppressed.

Fourth Embodiment

Figure 13:
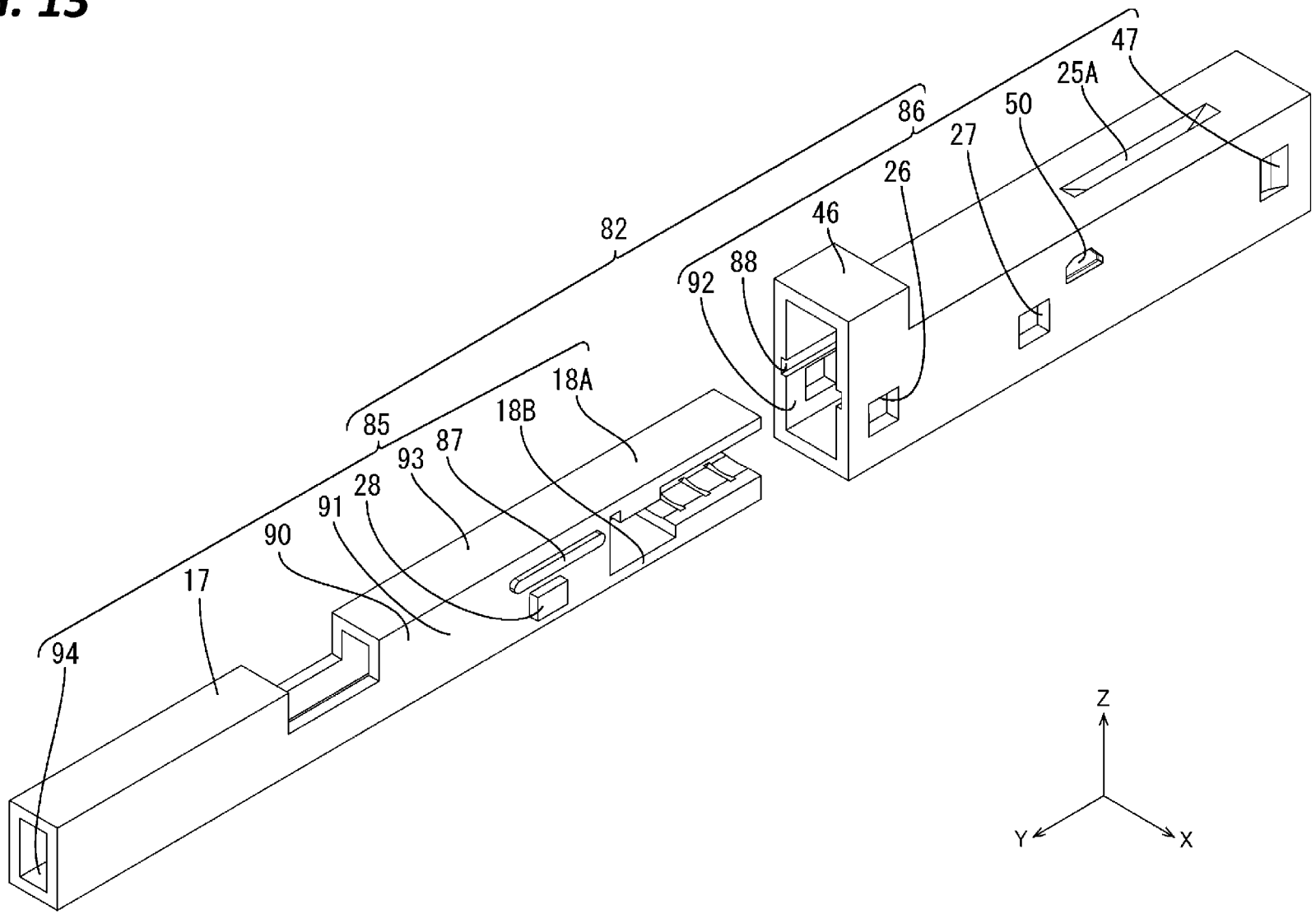
FIG. 13 is an exploded perspective view showing a terminal according to a fourth embodiment.

Next, a fourth embodiment of the present disclosure is described with reference to FIGS. 13 to 15. As shown in FIG. 13, a terminal 82 includes a terminal body 85 and a slide portion 86. A wire connecting portion 90 includes a pair of body-side side walls 91 intersecting an upper wall 93 provided with an upper sandwiching portion 18A and a lower wall 94 provided with a lower sandwiching portion 18B. Engaging projections 87 projecting outward are formed at positions above a locking projection 28 on the body-side side walls 91 of the wire connecting portion 90. The engaging projections 87 are in the form of ribs elongated in the front-rear direction. Front and rear end parts of the engaging projections 87 are formed into a curved surface shape.

Figure 14:
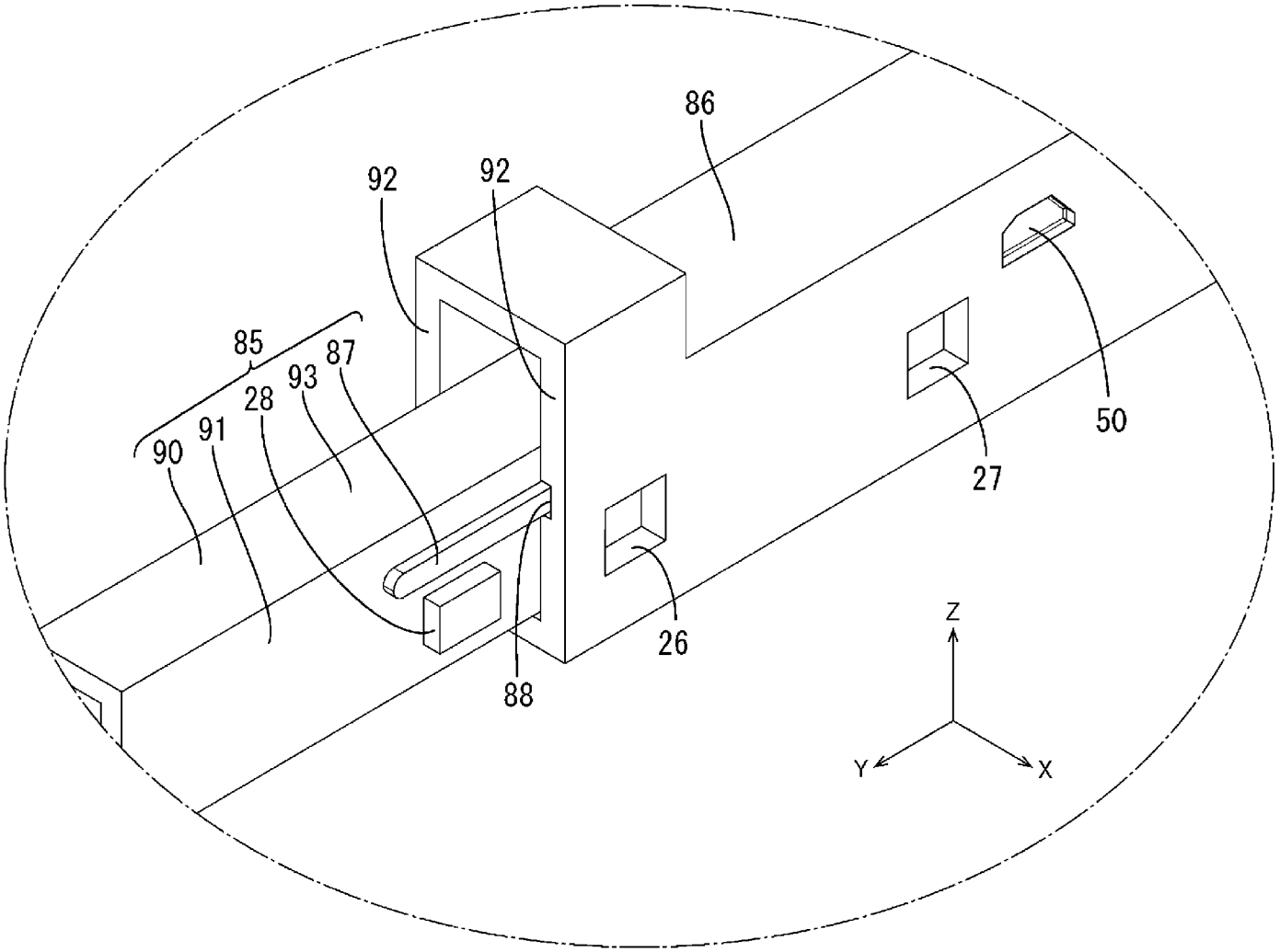
FIG. 14 is a partial enlarged perspective view showing a state where an engaging projection is accommodated in an engaging recess.
Figure 15:
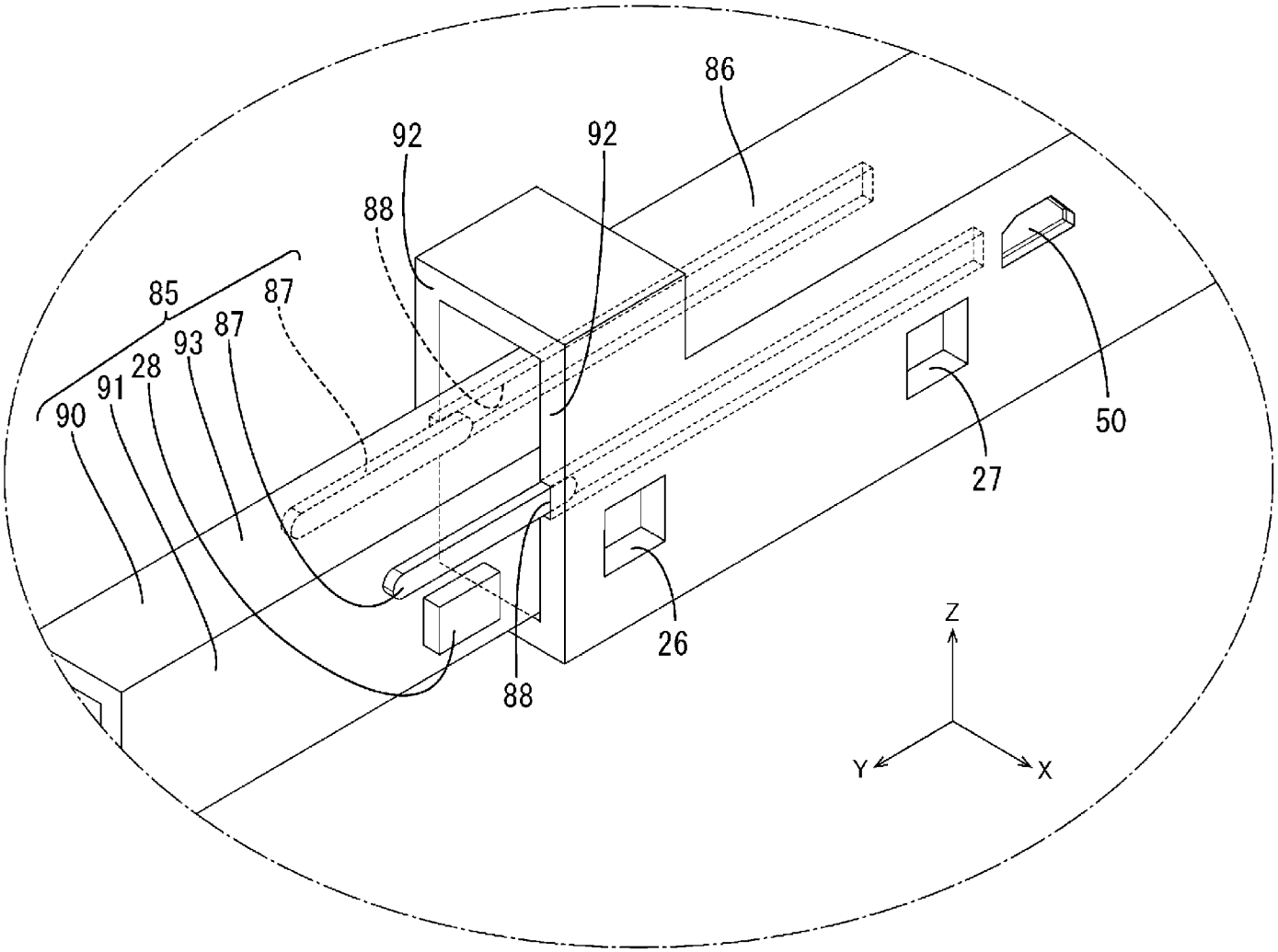
FIG. 15 is a perspective view showing an engaging projection and engaging recesses not shown in FIG. 14 by broken lines.

As shown in FIGS. 13 and 14, slide-side side walls 92 of the slide portion 86 are formed with engaging recesses 88, into which the engaging projections 87 are accommodated, at positions corresponding to the engaging projections 87 of the wire connecting portion 90 with the slide portion 86 externally fit to the wire connecting portion 90. The engaging recesses 88 extend in the front-rear direction. Front end parts of the engaging recesses 88 are open forward. The engaging recesses 88 do not penetrate through the slide-side side walls 92 of the slide portion 86. The engaging recesses 88 have a rectangular cross-sectional shape.

A vertical height of the engaging projections 87 is equal to or somewhat smaller than a vertical width of the engaging recesses 88. In this way, the engaging projections 87 are accommodated into the engaging recesses 88 in such a state movable in the front-rear direction in the engaging recesses 88.

A length in the front-rear direction of the engaging recesses 88 is so set that rear end parts of the engaging projections 87 do not interfere with the engaging recesses 88 with the slide portion 86 held at full locking position with respect to the terminal body 85.

Since the configuration other than the above is substantially the same as in the first embodiment, the same members are denoted by the same reference signs and repeated description is omitted.

According to this embodiment, the terminal body 85 includes the body-side side walls 91 intersecting the upper wall 93 provided with the upper sandwiching portion 18A and the lower wall 94 provided with the lower sandwiching portion 18B, the slide portion 86 includes the slide-side side walls 92 intersecting an upper pressurizing wall 31 provided with an upper pressurizing portion 25A and a lower pressurizing wall 32 provided with a lower pressurizing portion 25B, the body-side side walls 91 include the engaging projections 87 projecting toward the slide-side side walls 92, the slide-side side walls 92 include the engaging recesses 88, into which the engaging projections 87 are accommodated, at the positions corresponding to the engaging projections 87, and both the engaging projections 87 and the engaging recesses 88 extend along the front-rear direction.

The engaging projections 87 accommodated into the engaging recesses 88 contact the inner walls of the engaging recesses 88, whereby relative position shifts of the terminal body 85 and the slide portion 86 are suppressed. In this way, the rattling of the terminal body 85 and the slide portion 86 by receiving vibration or the like can be suppressed. Specifically, upper and lower end parts of the engaging projections 87 respectively contact upper and lower parts of the inner walls of the engaging recesses 88, whereby position shifts of the terminal body 85 and the slide portion 86 in the vertical direction are suppressed. Further, left and right end parts of the engaging projections 87 respectively contact left and right end parts of the inner walls of the engaging recesses 88, whereby position shifts of the terminal body 85 and the slide portion 86 in the lateral direction are suppressed.

Further, since the engaging projections 87 and the engaging recesses 88 extend along the front-rear direction, the slide portion 86 can smoothly move along the front-rear direction.

Other Embodiments

The present disclosure is not limited to the above described and illustrated embodiments. For example, the following embodiments are also included in the technical scope of the technique disclosed in this specification.

(1) The restricting portion may be formed by cutting and raising the side wall of the slide portion. For example, a hole such as a full lock receiving portion or a partial lock receiving portion may be formed by cutting and raising the restricting portion.

(2) The restricting portion may have a polygonal shape such as a triangular shape, a rectangular shape or a pentagonal shape or an oval or elliptical shape, and any shape can be appropriately selected.

(3) One, three or more sandwiching portions may be provided.

(4) The restricting portion may be formed in front of the lower pressurizing portion.

(5) A restricting portion formed as a component separate from a slide portion may be assembled with the slide portion.

(6) The engaging projection 87 according to the fourth embodiment may have an arbitrary shape such as a cylindrical shape or a quadrangular prism shape.

(7) The engaging recess 88 according to the fourth embodiment may penetrate through the side wall of the slide portion 86. An arbitrary shape such as a U shape or a V shape can be adopted as a cross-sectional shape of the engaging recess 88.

LIST OF REFERENCE NUMERALS

10: wire with terminal
11: wire
12, 80: terminal
13: core
14: insulation coating
15, 75, 85: terminal body
16, 66, 86: slide portion
16A: wide portion
16B: narrow portion
17: tube portion
18A, 78A: upper sandwiching portion
18B: lower sandwiching portion
19: resilient contact piece
20, 90: wire connecting portion
23A: upper holding protrusion
23B: lower holding protrusion
25A: upper pressurizing portion
25B: lower pressurizing portion
26: partial lock receiving portion
27: full lock receiving portion
28: locking projection
30: body-side side wall
31: upper pressurizing wall
32: lower pressurizing wall
33: slide-side side wall
45: jig
46: jig contact portion
47: guiding portion
50, 60: restricting portion
51, 61: front inclined portion
52, 62: rear inclined portion
70: first easily bendable portion
71: second easily bendable portion
73: projection
76: excessive deflection suppressing portion
87: engaging projection
88: engaging recess
90: wire connecting portion
91: body-side side wall
92: slide-side side wall

What is claimed is:

1. A terminal to be connected to a wire, comprising:

a terminal body including a sandwiching portion for sandwiching the wire; and a tubular slide portion for accommodating the terminal body inside, the slide portion being slidable with respect to the terminal body, wherein:

the slide portion includes a wide portion located on a front side in a sliding direction of the slide portion and a narrow portion located behind the wide portion in the sliding direction, an inner shape of the slide portion being narrower in the narrow portion than in the wide portion, the narrow portion is provided with a pressurizing portion projecting inwardly of the slide portion, the pressurizing portion presses the sandwiching portion toward the wire with the slide portion slid in the sliding direction with respect to the terminal body and the narrow portion located outside the sandwiching portion, and the slide portion is provided with a restricting portion on a side forward of the pressurizing portion in the sliding direction, the restricting portion restricting bending of the sandwiching portion.

2. The terminal of claim 1, wherein:

the slide portion is so assembled with the terminal body as to be movable between a full locking position where the pressurizing portion is in contact with the sandwiching portion and a partial locking position where the pressurizing portion is separated from the sandwiching portion, and the bending of the sandwiching portion is restricted by the restricting portion with the slide portion disposed at the partial locking position.

3. The terminal of claim 1, wherein:

the slide portion includes a pressurizing wall provided with the pressurizing portion and a slide-side side wall intersecting the pressurizing wall, the restricting portion projects inwardly of the slide portion from an inner surface of the slide-side side wall, and the sandwiching portion passes between the pressurizing wall and the restricting portion when the slide portion slides.

4. The terminal of claim 1, wherein:

the slide portion includes a pressurizing wall provided with the pressurizing portion and a slide-side side wall intersecting the pressurizing wall, and a front inclined portion formed to widen an interval between the restricting portion and the pressurizing wall toward a front side in the sliding direction is provided on a front side in the sliding direction of the restricting portion.

5. The terminal of claim 1, wherein a rear inclined portion inclined in a pressurizing direction of the pressurizing portion to pressurize the sandwiching portion toward a rear side in the sliding direction is provided on a rear side in the sliding direction of the restricting portion.

6. The terminal of claim 1, wherein the sandwiching portion is provided with a projection extending in the sliding direction and projecting in the pressurizing direction of the pressurizing portion to pressurize the sandwiching portion or a direction opposite to the pressurizing direction.

7. The terminal of claim 6, wherein the sandwiching portion is provided with an easily bendable portion formed to be narrower than other parts, and the projection is formed to cross the easily bendable portion.

8. The terminal of claim 1, wherein:

the terminal body includes a body-side side wall intersecting a wall portion provided with the sandwiching portion, the slide portion includes a slide-side side wall intersecting a pressurizing wall provided with the pressurizing portion, one of the body-side side wall and the slide-side side wall includes an engaging projection projecting toward the other and the other of the body-side side wall and the slide-side side wall includes an engaging recess at a position corresponding to the engaging projection, the engaging projection being accommodated into the engaging recess, and one or both of the engaging projection and the engaging recess extend along the sliding direction.

9. A wire with terminal, comprising:
the terminal of claim 1; and
a wire to be connected to the terminal.

* * * * *